US009180356B2

(12) United States Patent
Myrland

(10) Patent No.: US 9,180,356 B2
(45) Date of Patent: Nov. 10, 2015

(54) BATTER'S EYE APPARATUS AND SYSTEM

(71) Applicant: James W. Myrland, Belleville, WI (US)

(72) Inventor: James W. Myrland, Belleville, WI (US)

( * ) Notice: Subject to any disclaimer, the term of this patent is extended or adjusted under 35 U.S.C. 154(b) by 0 days.

(21) Appl. No.: 14/206,482

(22) Filed: Mar. 12, 2014

(65) Prior Publication Data

US 2014/0262064 A1 Sep. 18, 2014

Related U.S. Application Data

(60) Provisional application No. 61/785,243, filed on Mar. 14, 2013, provisional application No. 61/817,903, filed on May 1, 2013.

(51) Int. Cl.

| | |
|---|---|
| ***A47H 5/03*** | (2006.01) |
| ***A63B 71/02*** | (2006.01) |
| ***A63B 69/00*** | (2006.01) |

(52) U.S. Cl.

CPC ..... *A63B 71/02* (2013.01); *A63B 69/0002* (2013.01); *A63B 71/022* (2013.01); *A63B 2071/024* (2013.01); *A63B 2210/50* (2013.01)

(58) Field of Classification Search

CPC ..... A63B 71/022; A63B 71/023; A47H 5/03
USPC ..... 160/84.01, 84.06, 252, 254, 261.34; 473/421; 40/601, 607.09, 624, 603; 256/65.14, 23

See application file for complete search history.

(56) References Cited

U.S. PATENT DOCUMENTS

| | | | | |
|---|---|---|---|---|
| 6,938,785 | B2 * | 9/2005 | Denny et al. | 211/183 |
| 2005/0188571 | A1 * | 9/2005 | Wilson | 40/601 |
| 2006/0089461 | A1 * | 4/2006 | Mayes et al. | 525/242 |
| 2014/0262064 | A1 * | 9/2014 | Myrland | 160/84.02 |

FOREIGN PATENT DOCUMENTS

DE 4105137 A1 * 8/1992

* cited by examiner

*Primary Examiner* — Blair M Johnson
(74) *Attorney, Agent, or Firm* — Boardman & Clark LLP

(57) ABSTRACT

A batter's eye or backdrop apparatus and system, and to a free-standing deployable batter's eye apparatus and system, including a panel which may be raised, lowered and/or removed, as desired. The apparatus and system are easy to install and maintain, designed to tolerate design wind loads by changing orientation, shape and/or area presented to winds in response to the winds and/or wind pressures. The batter's eye apparatus is flexible and allows for movement in instantaneous wind modes, thereby reducing the complexity and cost of a support structure for the batter's eye and the batter's eye system. The batter's eye also includes a panel, screen or sheet that may be raised, and lowered closer to the ground to provide further protection against damage due to winds and/or weather.

20 Claims, 8 Drawing Sheets

FIG. 5
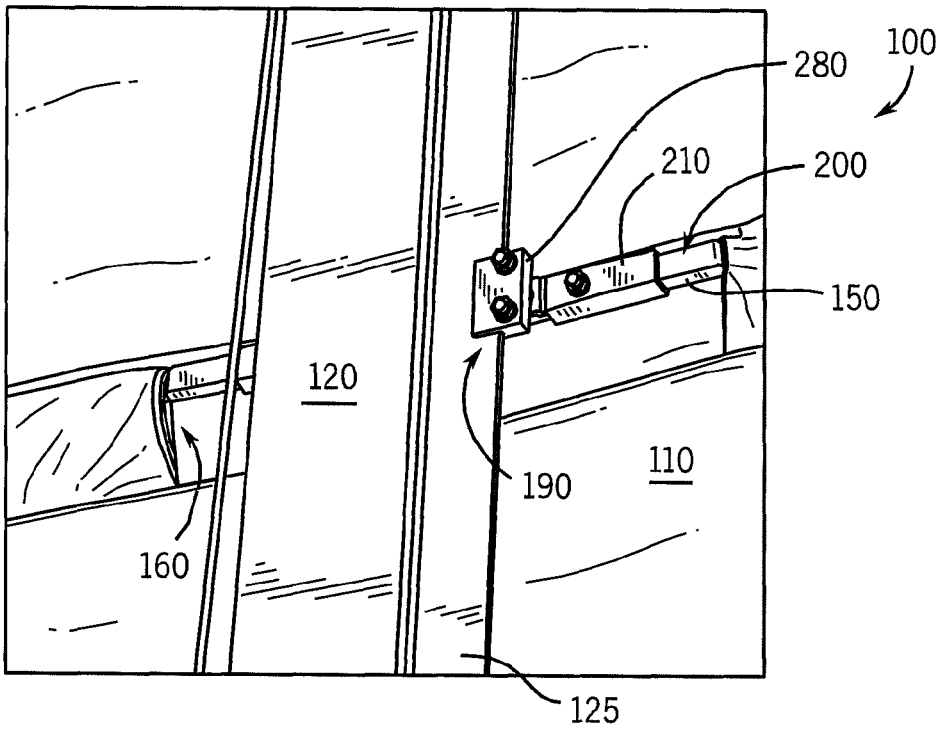
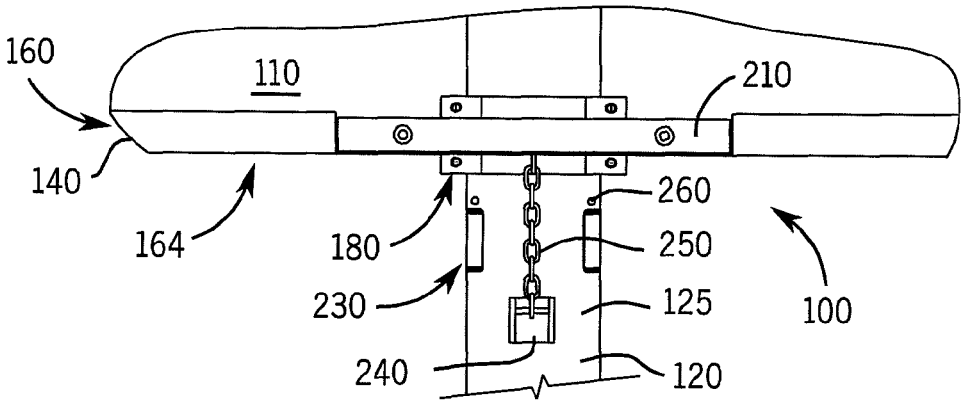
FIG. 6

BATTER'S EYE APPARATUS AND SYSTEM

CROSS-REFERENCE TO RELATED APPLICATIONS

This application claims priority to U.S. Provisional Patent Application Ser. No. 61/785,243 filed Mar. 14, 2013, and U.S. Provisional Patent Application Ser. No. 61/817,903 filed May 1, 2013, each of which is hereby incorporated herein by reference in its entirety.

BACKGROUND

A batter's eye or backdrop is typically a solid-colored, usually dark, area beyond an outfield or centerfield wall or fence of a baseball diamond, stadium or field. It is a visual backdrop directly in a line of sight of a baseball batter at home plate while facing a pitcher or pitching mound. The dark backdrop helps the batter to see a pitched ball, and its primary purpose is the safety of the batter. In addition, the batter's eye helps eliminate any unfair advantage that the pitcher may have if the background were light or white colored.

In some stadiums, there are seats behind centerfield. They are often painted a dark color or otherwise covered with a large black fabric and not occupied during baseball games and can themselves serve as a batter's eye. Such a solution, however, does not work well where there are no seats or another suitable structure already in place behind the outfield or centerfield wall.

There is a long-felt need for a batter's eye that may be used in connection with baseball fields where there are no seats or bleachers or other such structure beyond the outfield or centerfield. The apparatus should be easy to install, use and maintain. In addition, the apparatus should be designed to withstand the design maximum three-second wind gust for the particular location (e.g., 90 miles per hour in most locations, and higher in hurricane zones). In addition, the apparatus should be deployable such that it may be raised or lowered closer to the ground quickly and easily, as desired.

SUMMARY

This application relates to a batter's eye or backdrop apparatus and system, and to a free-standing deployable batter's eye apparatus and system. The following disclosure describes a batter's eye that is easy to install and maintain. The following disclosure describes an apparatus and system that is designed to tolerate wind loads and/or design maximum gusts by changing orientation, shape and/or area presented to winds in response to the winds and/or wind pressures or gusts. It is one aspect of the present disclosure to provide an apparatus which is flexible and allows for movement in instantaneous wind modes, thereby reducing the complexity and cost of a support structure for the batter's eye and the batter's eye system as a whole. There is a further aspect of the present disclosure to provide a batter's eye that includes a panel that may be raised and lowered easily and quickly to provide further protection against damage due to winds and/or weather and also facilitate the removal of components of the batter's eye (such as the panel) for seasonal storage and maintenance.

This application relates to a batter's eye apparatus comprising a panel having a head edge and a foot edge; a first batten channel provided on the panel near the head edge of the panel and a second batten channel provided on the panel near the foot edge of the panel; a first batten at least partially provided in the first batten channel; a second batten at least partially provided in the second batten channel; a first batten car coupled to the first batten and slidably coupled to a support beam provided in an in-ground footing; and a second batten car coupled to the second batten and slidably coupled to the support beam.

This application further relates to a system of batter's eye apparatus comprising a first batter's eye apparatus, the first batter's eye apparatus comprising a panel having a head edge and a foot edge; a first batten channel provided on the panel near the head edge of the panel and a second batten channel provided on the panel near the foot edge of the panel; a first batten at least partially provided in the first batten channel; a second batten at least partially provided in the second batten channel; a first batten car coupled to the first batten and slidably coupled to a support beam provided in an in-ground footing; and a second batten car coupled to the second batten and slidably coupled to the support beam, and a second batter's eye apparatus, the second batter's eye apparatus comprising a panel having a head edge and a foot edge; a first batten channel provided on the panel near the head edge of the panel and a second batten channel provided on the panel near the foot edge of the panel; a first batten at least partially provided in the first batten channel; a second batten at least partially provided in the second batten channel; a first batten car coupled to the first batten and slidably coupled to a support beam provided in an in-ground footing; and a second batten car coupled to the second batten and slidably coupled to the support beam.

These and other features and advantages of devices, systems, and methods according to this invention are described in, or are apparent from, the following detailed descriptions of various examples of embodiments.

BRIEF DESCRIPTION OF DRAWINGS

Various examples of embodiments of the systems, devices, and methods according to this invention will be described in detail, with reference to the following figures, wherein:

FIG. 5 is a detailed view illustration of a portion of the batter's eye apparatus illustrated in FIG. 1, according to one or more examples of embodiments.

FIG. 6 is a detailed view illustration of the batter's eye apparatus illustrated in FIG. 1, according to one or more examples of embodiments.

Figure 1:
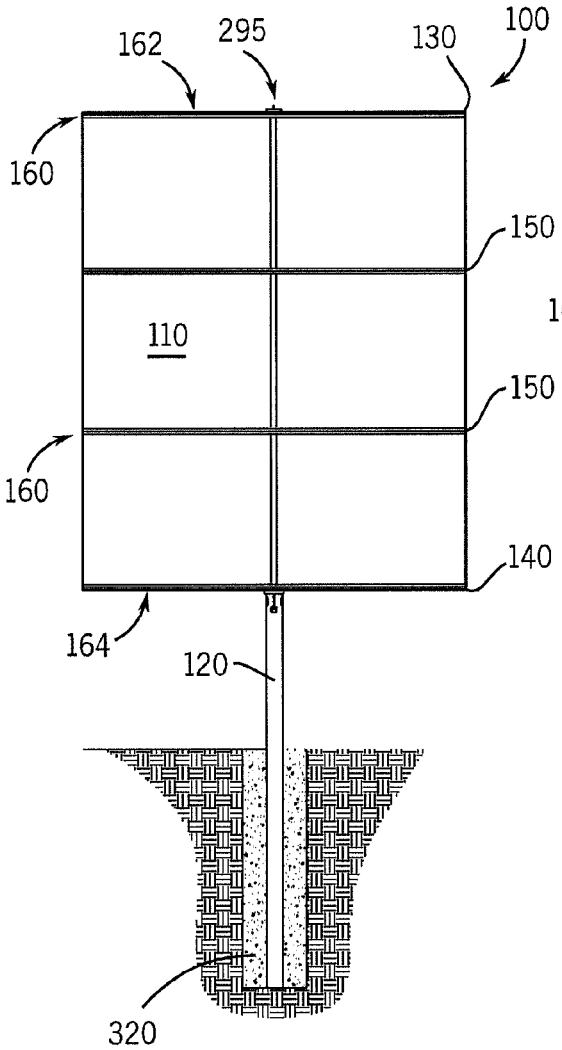
FIG. 1 is a front elevation view illustration of a batter's eye apparatus, according to one or more examples of embodiments.

While the disclosure is susceptible to various modifications and alternative forms, specific embodiments thereof have been shown by way of example in the drawings and are herein described below in detail. For example, any numbers, measurements, and/or dimensions illustrated in the Figures are for purposes of example only. Any number, measurement or dimension suitable for the purposes provided herein may be acceptable. It should be understood that the description of specific embodiments is not intended to limit the disclosure from covering all modifications, equivalents and alternatives falling within the spirit and scope of the disclosure.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

Unless defined otherwise, all technical and scientific terms used herein have the same meaning as commonly understood by one of ordinary skill in the art to which the disclosure belongs. Although any methods and materials similar to or equivalent to those described herein may be used in the practice or testing of the present disclosure, example methods and materials are described below.

Figure 2:
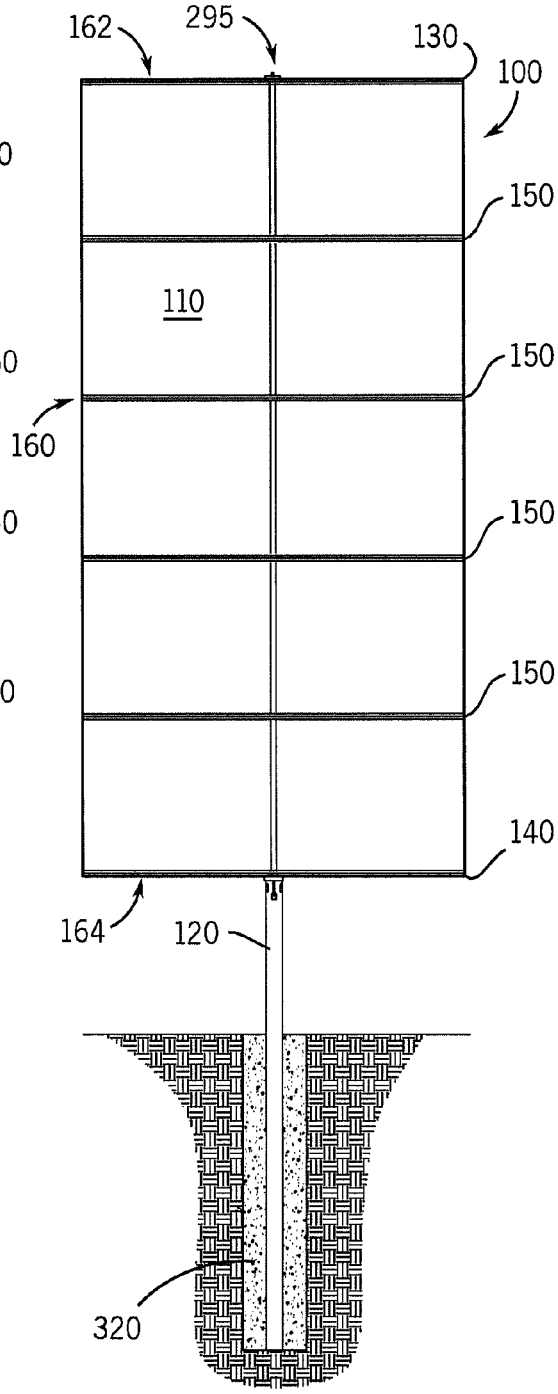
FIG. 2 is a front elevation view illustrated of a batter's eye apparatus, according to one or more examples of embodiments.
Figure 3:
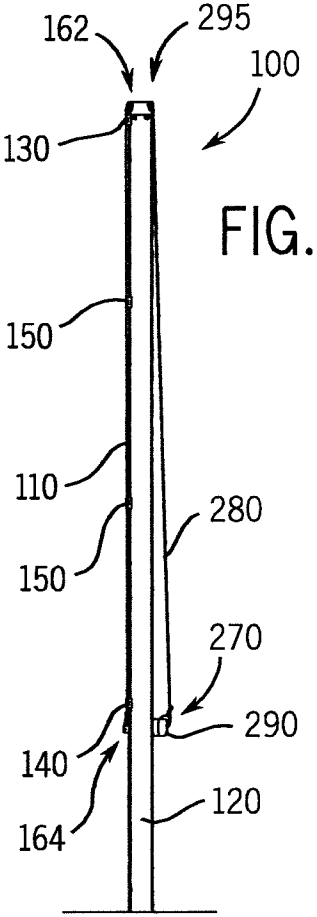
FIG. 3 is a side elevation view illustration of the batter's eye apparatus illustrated in FIG. 1, according to one or more examples of embodiments.

Example embodiments of a batter's eye apparatus 100 of the present disclosure is shown in FIGS. 1-7. In various embodiments, batter's eye apparatus 100 includes a screen, sheet or panel 110 and at least one support beam 120. In various embodiments, support beam 120 includes a flange 125. In various embodiments, batter's eye apparatus 100 includes a first or upper batten 130 and a second or lower batten 140. In various embodiments, batter's eye apparatus 100 includes one or more intermediate battens 150, provided between first batten 130 and second batten 140 (e.g., in a spaced relationship). In various embodiments, first batten 130, second batten 140 and/or any intermediate battens 150 are provided in batten channels, rings, pockets, or other batten apertures 160 defined by or otherwise coupled to panel 110. In various embodiments, first batten 130, second batten 140, and/or intermediate battens 150 reside or are provided within batten apertures 160 formed in and/or part of panel 110. In various embodiments, and as shown in the drawings, one or more batten apertures 160 are spaced (e.g., vertically) from about a head edge 162 of panel 110 to about a foot edge 164 of panel 110. While first batten 130, second batten 140, and two intermediate battens 150 in batten apertures 160 are shown in FIG. 1, it should be appreciated, that any number of the battens and/or batten apertures may be utilized within the spirit and scope of the disclosure. For example, and as shown in FIG. 2, batter's eye 100 may include first batten 130, second batten 140, and more than two (e.g., four) intermediate battens 150, and corresponding batten apertures 160. In addition, while the battens and batten apertures are shown as being continuous, the battens and/or batten apertures may be discontinuous or unconnected.

In various embodiments, first batten 130 and second batten 140 are releasably, slidably or otherwise operatively coupled to support beam 120 by at least a first batten car or member 170 and a second batten car or member 180, respectively. In various embodiments, intermediate battens 150 are releasably, slidably or otherwise operatively coupled to support beam 120 by intermediate batten cars or members 190. In various embodiments, intermediate batten cars 190 are coupled, connected, or otherwise operatively coupled, to first batten car 170, for example, by panel 110 and/or other member such as a cable.

Figure 4:
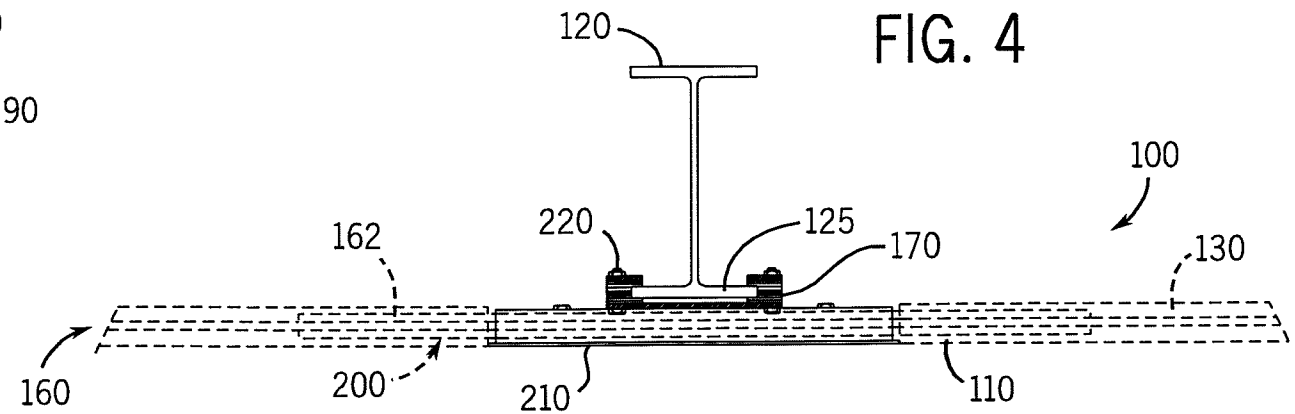
FIG. 4 is a partial detailed top view illustration of a portion of the batter's eye apparatus illustrated in FIG. 1, according to one or more examples of embodiments.

In various embodiments, first, second, and/or intermediate batten cars 170/180/190 are adapted and/or configured to releasably or slidebly grip a face portion, section and/or flange 125 of support beam 120. FIGS. 4-6 help illustrate how, in various embodiments, first, second, and/or intermediate batten cars 170/180/190 slideably or releasedly engages flange 125 of support beam 120. For example, in various embodiments, a multi-piece batten stack 200 is fastened or otherwise coupled (e.g., bolted) into a car tube or cross tube 210 and cross tube 210 is fastened or otherwise coupled (e.g., bolted) to glide blocks 220 that are adapted to receive flange 125 of support beam 120.

Figure 7:
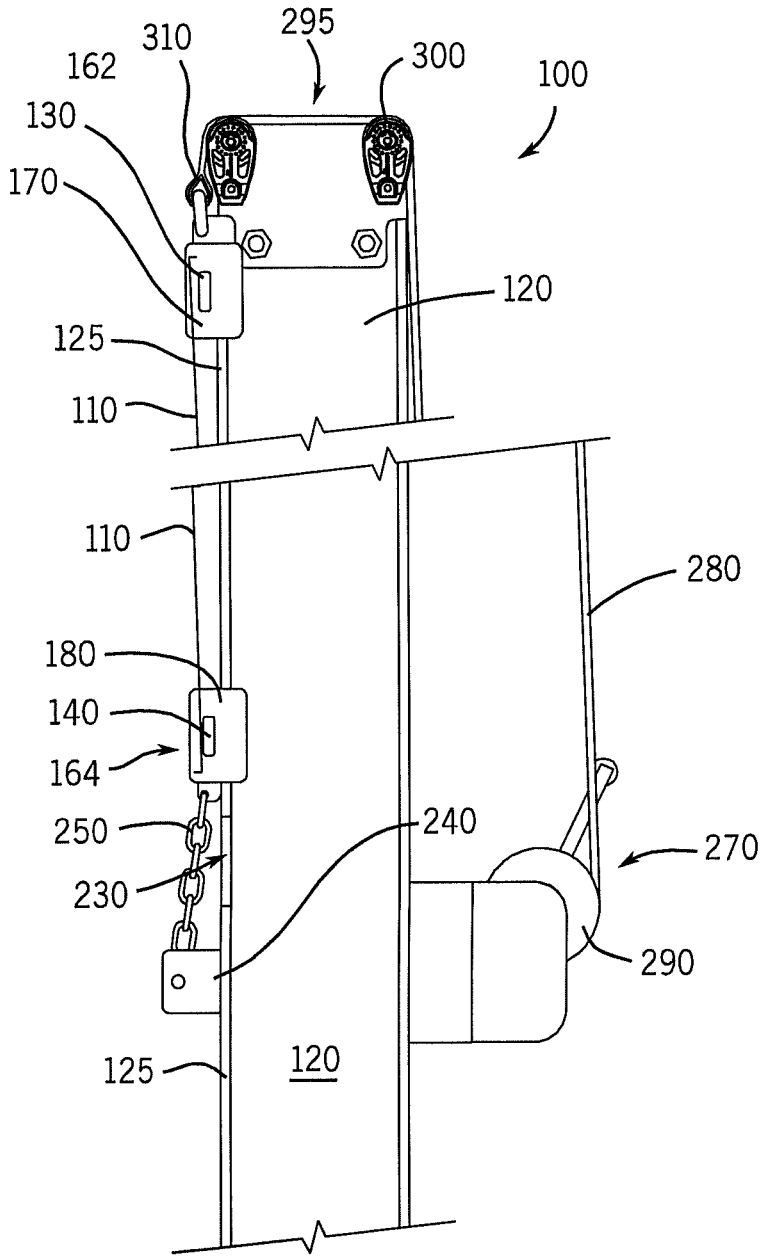
FIG. 7 is a detailed view illustration of two portions of the batter's eye apparatus illustrated in FIG. 1, according to one or more examples of embodiments.
Figure 8:
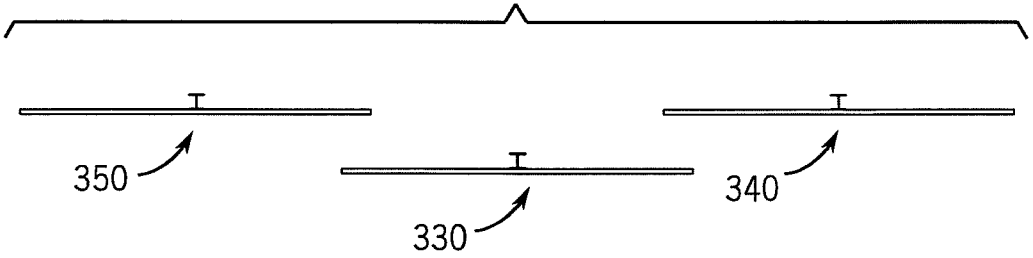
FIG. 8 is a schematic top-plan representation of a system of three batter's eye apparatus, according to one or more examples of embodiments.
Figure 9:
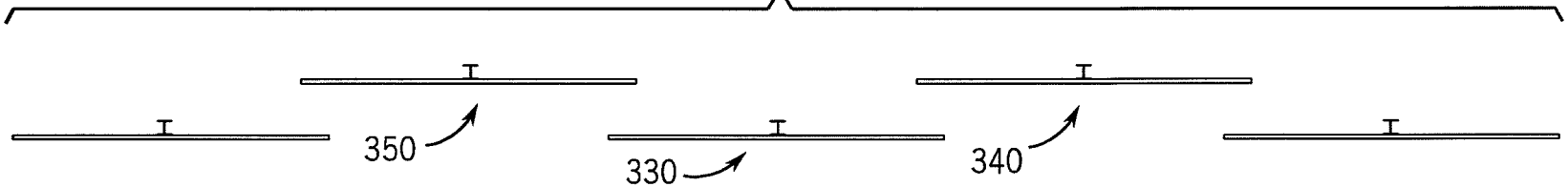
FIG. 9 is a schematic top-plan representation of a system of five batter's eye apparatus, according to one or more examples of embodiments.
Figure 10:
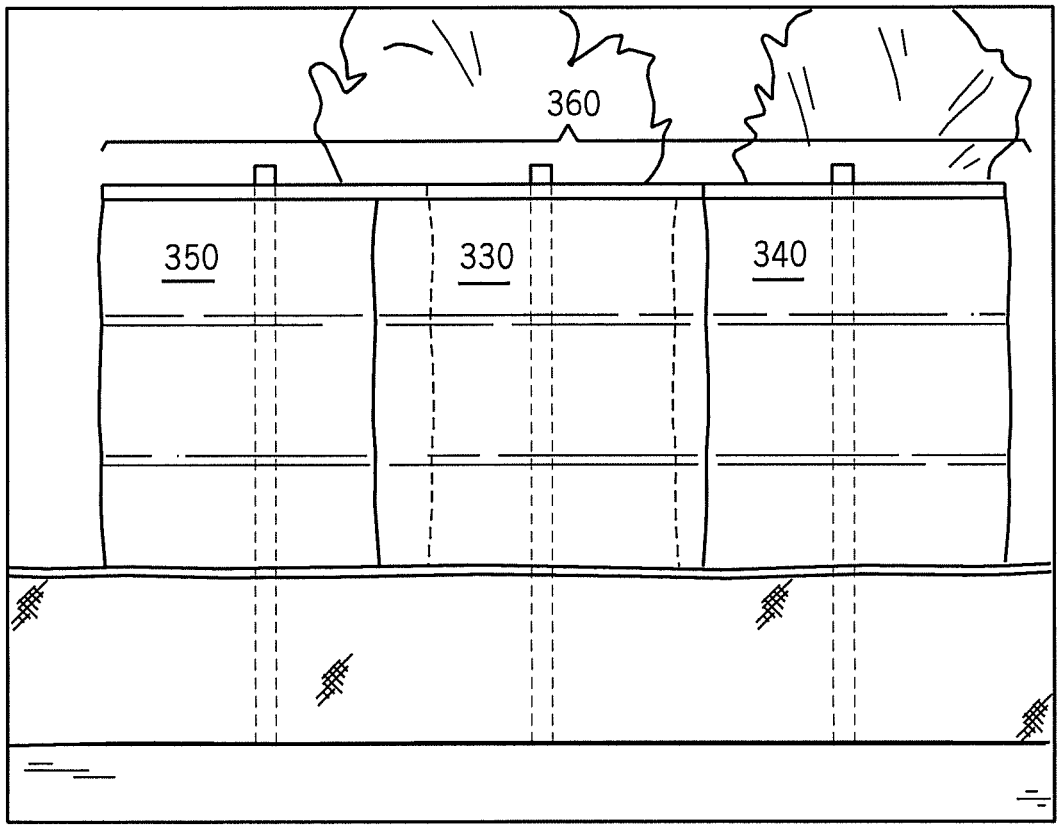
FIG. 10 is a front perspective view illustration of the batter's eye apparatus system or configuration illustrated in FIG. 8, according to one or more examples of embodiments.
Figure 11:
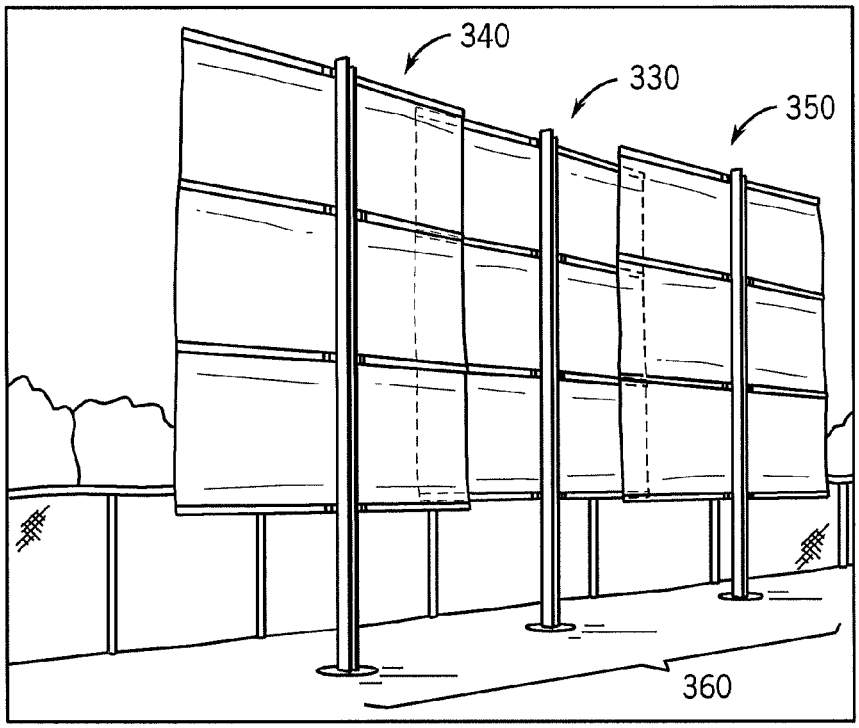
FIG. 11 is a rear perspective view illustration of the system or configuration illustrated in FIG. 8, according to one or more examples of embodiments.

Referring more specifically to FIGS. 6-7, in various embodiments, a portion or section of support beam 120 or flange 125 includes or defines one or more notches, slots, or recesses 230 to allow first, second, and/or intermediate batten cars 170/180/190 to be provided or fed onto support beam 120 and/or removed or disengaged (e.g., for seasonal storage) from support beam 120, as desired. In various embodiments, a down haul member or bracket 240 is coupled or operatively coupled to flange 125 and second batten car 180 on other components of batter's eye apparatus 100 (e.g., by a chain or linkage 250). In various embodiments, one or more removable or moveable pins 260 are provided above one or more notches, slots, or recesses 230 to help prevent a batten car (e.g., second batten car 180) from dropping to or into slot 230, unless so desired.

In various embodiments, batter's eye apparatus 100 includes a lifting system 270. In various embodiments, batter's eye apparatus 100 includes a winch-operated lifting system 270. In various embodiments, lifting system 270 and batter's eye apparatus 100 includes a halyard 280 coupled or operatively coupled to a winch 290. It should be appreciated that the lifting system and/or the winch may be motorized and/or manually operated. In various embodiments, halyard 280 is coupled or operatively coupled to one or more batten cars (e.g., first batten car 170). In various embodiments, halyard 280 runs above, to, or near a top or first end of support beam 120 and across two or guide blocks or members 300. In various embodiments, halyard 280 is coupled or operatively coupled, for example, by way of a shackle 310, to first batten car 170. The halyard may also be coupled or operatively coupled to second batten car 180 and any intermediate batten cars 190.

In various embodiments, panel 110 is made of fabric. The panel may be a continuous material or pieced (e.g., stitched) together. In various embodiments, panel 110 is made of a sewn fabric rectangle. While the panel may be made of any type of fabric, in various embodiments, panel 110 is made out of 100% woven polypropylene. It should be appreciated that while the fabric count of the fabric may be within any suitable ranges for the purpose of the disclosure, an example fabric count is 60 warp by 50 fill. While a variety of fabric visibility blockage may work satisfactorily in connection with the present disclosure, in various embodiments, the fabric utilized has a visibility blockage of approximately 94%.

While the fabric of the panel may be any suitable thickness, in various embodiments, the thickness of the fabric of panel 110 is approximately 20 mil, based upon ASTM D-17777. While various fabric weights may be utilized in connection with this present disclosure, in various embodiments, the weight of the fabric of panel 110 is approximately 7.7 ounces per yard squared, based upon ASTM D-3776-85. While the fabric utilized by the present invention may be of any suitable tensile strength, in various embodiments, the warp tensile strength of the fabric is approximately 445 pounds, and the fill tensile strength of the fabric is approximately 375 pounds, based upon ASTM D-5034.

In various embodiments, first batten 130, second batten 140 and/or intermediate battens 150 are made of a flexible or resilient material. In various embodiments, first, second and/or intermediate battens 130/140/150 are made of fiberglass. It should be appreciated, however, that the battens may be made of any suitable material. The halyard may also be made any suitable material including metal or fabric, and may take a variety of forms including a line, a rope, a cable, etc.

The support beam may be made of any suitable metal or other material. In various embodiments, support beam 120 is made of a structural steel alloy such as ASTM 992 steel. In various embodiments, the material of support beam 120 is finished with a primer such as Sherwin Williams EASE-00025 zinc-rich primer and a powder coat such as Sherwin Williams FBS6-C2476 black. It should be appreciated, however, that any suitable finish and/or powdered coat may be utilized within this period of scope of the disclosure.

In various embodiments, and referring more specifically to FIGS. 1-2, support beam 120 is or is adapted to be provided in a footing 320 (e.g., an in-ground footing). The dimensions and/or placement of the footing may depend at least in part on batter's eye apparatus size and soil conditions, including local soil load-bearing values. By way of example, the footing for a 20-foot tall batter's eye apparatus may have a nominal depth of approximately seven feet six inches (7'6") and a nominal diameter of approximately twenty-four inches. The footing for a 30-foot tall batter's eye apparatus may have a nominal depth of approximately ten feet (10') and a nominal diameter of approximately twenty-four inches. Footing 320, in various embodiments, is made of 3,500 PSI minimum concrete.

While support beam 120 is shown as extending into footing 320 in a direct-bury method, in various embodiments, the support beam may be made up of multiple pieces, sections, or lengths. For example, the support beam may include multiple sections with mating plates (e.g., provided between the footing and the panel). In various embodiments, the support beam may couple to a base plate anchored into the footing. In various embodiments, and as shown in the Figures, support beam 120 is an I-beam, the cross section of which may be based on various factors including the overall height of the beam above the surface of the ground, local wind speed requirements, etc. The support beam can, however, take a variety of cross-sectional shapes including a T-shape, an H-shape, or C-shape, tube-shaped, etc.

Referring to FIG. 6, slots 230 in flange 125 of support beam 120 allow first, second, and any intermediate batten cars 170/180/190 to be inserted and then lifted to engage flange 125 of support beam 120. Slots or notches 230 allow assembled batten/batten cars 170/180/190 to be fed onto support beam 120 (e.g., as head edge 162 of panel 110 is raised). In various embodiments, in operation, when lifting system 270 and/or winch 290 is operated (e.g., in one direction), halyard 280 lifts or raises first batten car 170 thereby lifting or otherwise carrying first batten 130 and head edge 162 of panel 110 up or along support beam 120 toward end 295 of support beam 120, or any guide blocks 300.

In various embodiments, halyard 280 lifting or moving first batten car 170 also operatively pulls, raises, carries, or moves second batten car 180, and/or intermediate batten cars 190 to or toward a desired and/or pre-determined spacing. In various embodiments, any intermediate batten cars 190 and/or second batten car 180, and the associated battens, help provide downward tension on panel 110 to help smooth, flatten, or otherwise tension panel 110.

Once panel 110 is raised, hoisted, or deployed, or all batten cars 170/180/190 are otherwise engaging support beam 120 above one or more pinholes provided above slots 230 and defined in support beam 120, one or more car stop pins 260 may be inserted into the pinholes to prevent second batten car 180 from reaching, re-entering, or exiting slots 230 (e.g., when panel 110 and/or one or more battens 170/180/190 are lowered or allowed to move toward slots 230). Car stop pins 260 are also provided to help the batten cars stack into a lowered and/or storage position as panel 110 and/or one or more battens (e.g., first batten 170) are lowered or allowed to move toward slots 230.

Figure 12:
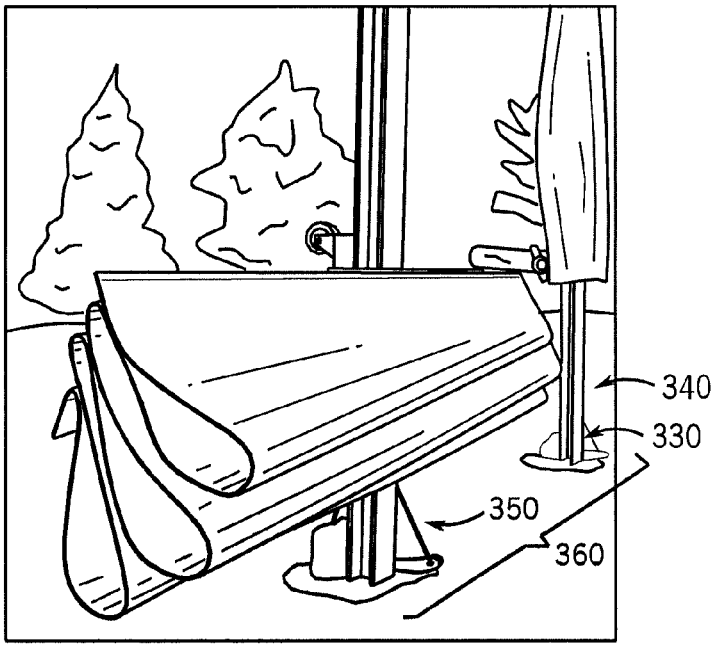
FIG. 12 is a side perspective view illustration of the system or configuration illustrated in FIG. 8, with a panel of a batter's eye apparatus in a lowered position, according to one or more examples of embodiments.

In various embodiments, reversal of lifting system 270 and/or winch 290 operation may lower at least head edge 162 of panel 110 toward slots 230 and/or the ground. In various embodiments, second batten car 180 drops or is allowed to drop to rest on one or more car stop pins 260. In various embodiments, one or more intermediate batten cars 190 and/or first batten car 170 may drop or drop to rest on or near an adjacent or other batten car nearer slots 230. In various embodiments, panel 110 folds, curls, or collapses between various batten cars 170/180/190 during reversal of lifting system 270 and/or winch 290 operation (see, e.g., FIG. 12).

Panel 110, batten cars 170/180/190, and any other assemblies may be removed from support beam 120 by removing one or more car stop pins 260 and allowing each batten car 170/180/190 to drop to or into slots 230 and otherwise disengage from support beam 120.

Referring now to FIGS. 8-14, in various embodiments, a first batter's eye apparatus 330 and a second batter's eye apparatus 340 (and/or a third batter's eye apparatus 350) may be used or provided to create a system 360 of batter's eye apparatus with a collective and/or combined wider or larger visual backdrop area (e.g., from a home plate and/or batter's perspective). For example, as shown in these Figures, first, second, and third batter's eye apparatus 330/340/350 may be provided to create the system 360 or a larger batter's eye or backdrop (e.g., from the perspective of the batter or home plate). It should be appreciated, however, that while first, second, and third three batter's eye apparatus 330/340/350 are shown in FIGS. 8-14, any number of the batter's eye apparatus (such as the five batter's eye apparatus shown in FIG. 9) may be provided or utilized as desired, to create system 360.

Figure 13:
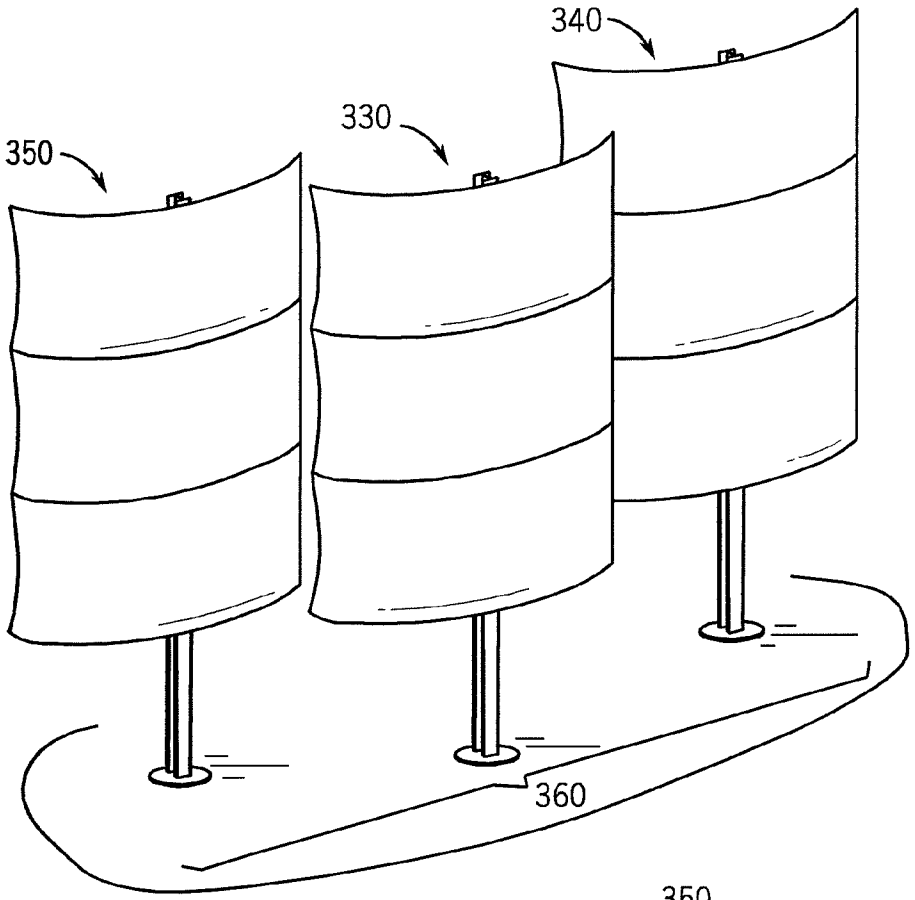
FIG. 13 is a perspective view illustration of the batter's eye apparatus system or configuration illustrated in FIG. 8 under a wind pressure or load, according to one or more examples of embodiments.
Figure 14:
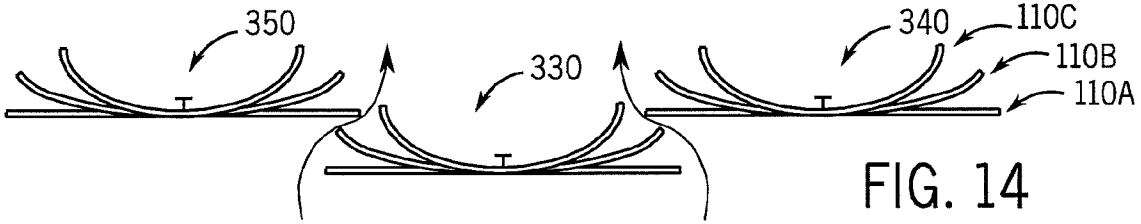
FIG. 14 is a schematic top plan view representation of the system of batter's eye apparatus illustrated in FIG. 8 under various wind pressures or loads, according to one or more examples of embodiments.

In various embodiments, second batter's eye apparatus 340 (and/or third batter's eye apparatus 350) are provided in an overlapping and/or staggered position relative to first batter's eye apparatus 330 (e.g., from a plan and front view). As shown in the Figures, first batter's eye apparatus 330 may be provided in one location, and second and/or third batter's eye apparatus 340/350 may be provided adjacent but partially behind first batter's eye 330 relative to a batter or home plate, or further from a batter or home plate. In various embodiments, second and/or third batter's eye apparatus 340/350 are set back from first batter's eye apparatus 330. Such a staggered, overlapped or setback position may allow the panel of each apparatus to move between the panels of the other batter's eye apparatus of system 330. In various embodiments, however, the overlap between the panels of first, second, and/or third batter's eye apparatus 330/340/350 of system 360 helps allow, as illustrated in FIGS. 13 and 14, movement of the panels, and wind and/or airflow 370 between the panels of first, second, and/or third batter's eye apparatus 330/340/350 of system 360, while reducing the chances or period of time that a visual light seam or hole will develop in the batter's eye system 360 or backdrop, from the batter's or home plate perspective that may reduce the effectiveness of system 360 (e.g., by making it more difficult for the batter to see a pitched ball, or otherwise create a distraction for the batter). For example, and referring to FIG. 14, the panels of first, second, and/or third batter's eye apparatus 330/340/350 may be able to adjust, move, re-shape, re-orient, etc., from first illustrative panel position and orientation 110A, to a second illustration panel position and orientation 110B, to a third illustrative panel position and orientation, as well as any multitude of other panel positions, orientations, and combinations thereof, to help allow apparatus 330/340/350/and/or system 360 spill or otherwise adjust to wind and airflow 370. The adjustment, movement, re-shaping and/or re-orientation helps the apparatus and system to tolerate wind loads and/or design maximum gusts. It can also reduce the complexity and cost of a support structure for the batter's eye and the batter's eye system as a whole.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The technical effects and technical problems in the specification are exemplary and are not limiting. It should be noted that the embodiments described in the specification may have other technical effects and can solve other technical problems.

The invention claimed is:

1. A batter's eye apparatus comprising:

a flexible panel having a head edge and a foot edge;

a first batten channel provided on the panel near the head edge of the panel and a second batten channel provided on the panel near the foot edge of the panel;

a first batten at least partially provided in the first batten channel;

a second batten at least partially provided in the second batten channel;

a first batten car coupled to a central portion along the length of the first batten and slidably coupled to a support beam provided in an in-ground footing;

a second batten car coupled to a central portion along the length of the second batten and slidably coupled to the support beam;

wherein one of the first and second batten cars are slidable to a position adjacent to the other one of the first and second batten cars.

2. The batter's eye apparatus of claim 1, wherein the first batten car is operatively coupled to a lifting system.

3. The batter's eye apparatus of claim 2, wherein the lifting system includes a winch.

4. The batter's eye apparatus of claim 1, further comprising an intermediate batten car slidably coupled to the support beam.

5. The batter's eye apparatus of claim 4, wherein the intermediate batten car is coupled to an intermediate batten provided in an intermediate batten channel provided between the first batten channel and the second batten channel.

6. The batter's eye apparatus of claim 1, wherein at least one of the first batten channel and second batten channel is defined by the panel.

7. The batter's eye apparatus of claim 1, wherein at least one of the first batten channel and second batten channel are defined by a batten channel member coupled to the panel.

8. The batter's eye apparatus of claim 1, wherein the first and second battens are flexible.

9. The batter's eye apparatus of claim 5, wherein the first, second and intermediate battens are flexible.

10. The batter's eye apparatus of claim 1, wherein the batter's eye apparatus is provided in a line of sight of a batter at home plate on a baseball field having an outfield to help provide a visual backdrop for the batter beyond the outfield of the baseball field.

11. A system of batter's eye apparatus comprising a first and second batter's eye apparatus of claim 1.

12. The system of batter's eye apparatus of claim 11, wherein the support beam of the first batter's eye apparatus is provided relatively closer to a home plate of a baseball field than the support beam of the second batter's eye apparatus.

13. The system of batter's eye apparatus of claim 12, wherein a portion of the panel of the first batter's eye apparatus and a portion of the panel of the second batter's eye apparatus appear to overlap when viewed from the perspective of home plate of a baseball diamond.

14. The system of batter's eye apparatus of claim 11, further comprising a third batter's eye apparatus.

15. The system of batter's eye apparatus of claim 14, wherein the support beam of the first batter's eye apparatus is provided relatively closer to a home plate of a baseball field than the support beam of the second batter's eye apparatus and the support beam of the third batter's eye apparatus.

16. The system of batter's eye apparatus of claim 14, wherein a first portion of the panel of the first batter's eye apparatus and a portion of the panel of the second batter's eye apparatus appear to overlap, and a second portion of the panel of the first batter's eye apparatus and a portion of the panel of the third batter's eye apparatus appear to overlap, when the first, second and third batter's eye apparatus are viewed from home plate of a baseball diamond.

17. The system of batter's eye apparatus of claim 11, wherein the first batter's eye apparatus and second batter's eye apparatus are staggered relative to each other.

18. The system of batter's eye apparatus of claim 14, wherein the first, second and third batter's eye apparatus are provided in a line of sight of a batter at home plate on a baseball field having an outfield to help provide a visual backdrop for the batter beyond the outfield of the baseball field.

19. A batter's eye apparatus comprising:

a flexible panel having a head edge and a foot edge;

a first batten channel provided on the panel near the head edge of the panel and a second batten channel provided on the panel near the foot edge of the panel;

a first batten at least partially provided in the first batten channel;

a second batten at least partially provided in the second batten channel;

a first batten car coupled to the first batten and slidably coupled to the support beam;

and a second batten car coupled to the second batten and slidably coupled to the support beam;

wherein the support beam is centrally-located relative to the panel and provided in an in-ground footing and wherein one of the first and second batten cars are slidable to a position adjacent to the other one of the first and second batten cars.

20. A batter's eye apparatus comprising:

a flexible panel having a head edge and a foot edge and side edges extending between the head edge and foot edge;

a first batten channel provided on the panel near the head edge of the panel and a second batten channel provided on the panel near the foot edge of the panel;

a first batten at least partially provided in the first batten channel;

a second batten at least partially provided in the second batten channel;

a first batten car coupled to the first batten and slidably coupled to the support beam; and a second batten car coupled to the second batten and slidably coupled to the support beam;

wherein the support beam is provided in an in-ground footing and extends between the side edges of the panel and wherein one of the first and second batten cars are slidable to a position adjacent to the other one of the first and second batten cars.

* * * * *